US005659621A

United States Patent [19]

Newton

[11] Patent Number: 5,659,621

[45] Date of Patent: *Aug. 19, 1997

[54] MAGNETICALLY CONTROLLABLE HEARING AID

[75] Inventor: James R. Newton, Burnsville, Minn.

[73] Assignee: Argosy Electronics, Inc., Eden Prairie, Minn.

[ * ] Notice: The portion of the term of this patent subsequent to Aug. 31, 2014, has been disclaimed.

[21] Appl. No.: 429,800

[22] Filed: Apr. 27, 1995

Related U.S. Application Data

[63] Continuation-in-part of Ser. No. 298,774, Aug. 31, 1994, Pat. No. 5,553,152.

[51] Int. Cl.[6] ..... H04R 25/00

[52] U.S. Cl. ..... 381/68; 381/68.6; 381/69; 607/57

[58] Field of Search ..... 381/68, 68.6, 68.2–68.4, 381/69, 69.2; 600/25; 607/56, 57; 128/746

[56] References Cited

U.S. PATENT DOCUMENTS

| | | | |
|---|---|---|---|
| 4,756,312 | 7/1988 | Epley | 381/68.6 |
| 4,879,749 | 11/1989 | Levitt et al. | 381/68 |
| 5,357,576 | 10/1994 | Arndt | 381/69 |
| 5,604,812 | 2/1997 | Meyer | 381/68 |
| 5,610,988 | 3/1997 | Miyahara | 381/68 |

FOREIGN PATENT DOCUMENTS

| | | | |
|---|---|---|---|
| 9417645 | 8/1994 | WIPO | 381/68 |

*Primary Examiner*—Curtis Kuntz
*Assistant Examiner*—Xu Mei
*Attorney, Agent, or Firm*—Palmatier, Sjoquist, Helget & Voigt, P.A.

[57] ABSTRACT

An apparatus for controlling an adjustable operational parameter of a hearing aid by the use of an external magnetic actuator held in proximity with the hearing aid. The hearing aid has a microphone for generating signals, hearing aid circuitry for processing the signals, an output transducer for transforming the processed signals to a user compatible form, and a single magnetic switch, such as a reed switch, connected to the hearing aid circuitry. The magnetic switch controls the hearing aid circuitry to adjust an adjustable operational parameter, such as volume. In one embodiment the adjustable operational parameter continues to adjust or cycle between a minimum and a maximum as long as the magnetic actuator is maintained in proximity with the magnetic switch. When the magnetic actuator is removed the adjustment ceases. The invention allows precise adjustment and control of an adjustable parameter with minimal effort and movement by the user. The hearing aid circuitry may include a memory to allow a desired setting of the adjustable operational parameter to be saved when the hearing aid is turned off.

14 Claims, 7 Drawing Sheets

MAGNETICALLY CONTROLLABLE HEARING AID

This is a continuation-in-part of application filed Aug. 31, 1994 with a Ser. No. 08/298,774 now U.S. Pat. No. 5,553,152.

BACKGROUND OF THE INVENTION

The present invention relates to hearing aids. More particularly, the invention relates to remote controlled hearing aids utilizing magnetic switches.

Hearing aids often offer adjustable operational parameters to facilitate maximum hearing capability and comfort to the users. Some parameters, such as volume or tone, may be conveniently user adjustable. Other parameters, such as filtering parameters, and automatic gain control (AGC) parameters are typically adjusted by the acoustician.

With regard to user adjustable parameters, it is awkward or difficult to remove the hearing aid for adjustment especially for individuals with impaired manual dexterity. Remotely controlled units may be utilized to adjust such desired functions inconspicuously and without removal of the hearing aid.

Various means have been utilized for the remote control of hearing aids. A remote actuator of some type is necessarily required for all remote controlled systems. Control signals from the remote actuator have been by way of several different types of media such as infrared radiation, ultrasonic signals, radio frequency signals, and acoustical signals.

Often times different listening situations will warrant different settings of various adjustable parameters for optimal hearing and comfort. This need may be addressed by preprogramming various groups of settings (programs) of the parameters into the memories of the hearing aids. When entering a different environment the user can select the most suitable group of settings of the adjustable parameters. The remote control selection of such programs has heretofore required transmission of coded or modulated signals to activate selection of the desired programs. Thus, necessitating an electrically complex remote actuator and receiver circuitry in the hearing aid. Obviously, where a remote actuator is inoperable or unavailable, selection of different programs would be impossible.

Remote actuators used to control parameters and select programs can have complicated controls which can make them difficult to understand and use by many hearing aid users. Moreover, users with limited manual dexterity due to arthritis, injuries, or other debilitating illnesses may find it difficult or impossible to operate remote controls with several push-button controls. Thus, there is a need for a simple to use remote controlled hearing aid requiring very limited manual dexterity and in which a number of hearing aid parameters may be controlled, either individually or by way of program selections.

As hearing aids have become more sophisticated they have also become smaller. "Completely in the canal" (CIC) hearing aids are currently available which are miniaturized sufficiently to fit far enough into the ear canal to be out of view. Such placement makes the hearing aid difficult to access with tools for adjusting the operational parameters. Moreover, such placement makes remote control where direct access is needed, such as infrared radiation, difficult or impossible.

In such state of the art hearing aids there is minimal face plate space for sensors or controls such as potentiometers.

Thus there is a need for a means of controlling adjustable operational parameters in state of the art miniaturized hearing aids without controls or sensors that take up face plate space.

The prior art discloses hearing aids that have utilized multiple magnetic reed switches, however these devices are awkward to use and are not practical for modern ultraminiature hearing aids which may be completely hidden within the ear canal. For example, U.S. Pat. No. 4,628,907 to John M. Epley, Dec. 16, 1986, discloses the use of a pair of magnetic reed switches in a hearing aid that is mechanically coupled to the user's ear drum. The configuration requires that the reed switches must be actuated individually to provide for increasing or decreasing the volume of the hearing aid. A special magnetic actuator and supplemental bias magnets are positioned in the hearing aid adjacent to the reed switches to facilitate the individual actuations of the reed switches.

U.S. Pat. No. 5,359,321 to Ribic issued on Oct. 25, 1994 discloses a hearing aid again utilizing at least two magnetic reed switches to control the hearing aid volume. The Ribic device requires that the reed switches be sequentially activated in a particular sequence by waving the magnetic actuator past the switches to step up or down the hearing aid volume. These devices do not fully utilize the inherent advantages of magnetic switches in that they require delicate adjustment operations and/or multiple precise movements to adjust the volume to a desired level.

SUMMARY OF THE INVENTION

A hearing aid having an adjustable operational parameter controllable by the use of an external magnetic actuator held in proximity with the hearing aid. The hearing aid has a microphone for generating signals, hearing aid circuitry for processing the signals, an output transducer for transforming the processed signals to a user compatible form, and a single magnetic switch, such as a reed switch, connected to the hearing aid circuitry. This invention is related to the invention claimed in the application filed Aug. 31, 1994 with a Ser. No. 08/298,774. That application focused on and claimed a hearing aid that switched between a plurality of adjustable operational parameters or memory settings by sequential actuations of the magnetic switch and adjusted a selected operational parameter by sustaining the actuation of the magnetic switch. This application provides further related disclosure and claims. One embodiment of the present instant invention provides that an adjustable parameter, such as volume, continues to adjust or cycle between a minimum and a maximum as long as the magnetic actuator is maintained in proximity with the magnetic switch. This allows precise adjustment and control of an adjustable parameter with minimal effort and movement by the user.

The device operates by moving a magnetic source into proximity with the hearing aid which closes the magnetic switch and activates the control processing circuitry to start adjusting the operational parameter. The control processing circuitry is configured to cycle the operation parameter at a predetermined rate through the range of available settings while the magnetic source is maintained in said proximity. When the adjustable parameter is at the desired adjustment position, the magnetic source is moved out of proximity which stops the adjustment of the operational parameter. The control circuitry may include a memory circuit to allow a desired setting of the adjustable operational parameter to be saved when the hearing aid is turned off. Moreover, a trimmer may be provided to adjust the adjustable operational parameter to a desired setting upon turning the device on.

A feature of the invention is that the adjustment of the operational parameter may be simply and inconspicuously accomplished by minimal movement and motion. The magnetic actuator is simply moved into proximity with the hearing aid for an amount of time as necessary to adjust the parameter, such as volume, to the desired setting and is then moved away. The user may cycle through the entire range of parameter settings without moving the actuator away from the hearing aid.

A feature of the invention is that the circuitry required in the hearing aid is quite limited in comparison to alternative remote control devices. The invention utilizes a single logic level input, that is, a single on/off switch as compared to modulated infrared radiation and RF signals that require detection, amplification, and decoding. Moreover, the device utilizes a single magnetic switch as opposed to multiple magnetic switches.

A feature of the invention is that the magnetic actuator utilizes no electrical circuitry, no electrical components, no batteries, and no moving parts. As a result, the magnetic actuator offers a very high level of reliability, is very durable, has a very long service life, and is essentially maintenance free.

A further object and advantage of the invention is that the remote actuator is small, inconspicuous, and may be easily carried in a pocket.

Another object and advantage of the invention is that, if the remote actuator is unavailable, substitute magnets may be utilized for adjusting the device.

A further object and advantage of the invention is that the system is essentially immune from sources of interference which can create difficulties for systems utilizing RF, infrared, or ultrasonic remote control.

An additional object and advantage of the invention is that the device needs a minimal amount of manual dexterity to adjust the operational parameters. The actuator only needs to be moved into proximity with the reed switch and maintained within said proximity to adjust the operational parameters.

Another object and advantage of the invention is that the hearing aid need not be removed from the ear for the adjustment of the adjustable operational parameters. Moreover, no adjustment tools need be inserted into the ear for said adjustment. Nor does the device need to be visually or physically accessible to adjust the parameters.

An additional object and advantage of the invention is that control of operational parameters in the hearing aid is accomplished without the use of conventional potentiometers and switches.

An additional object and advantage of the invention is that a wide variety of operational parameters may be controlled by the external magnetic actuator.

BRIEF DESCRIPTION OF THE DRAWINGS

FIG. 8 is a schematic of an example of control processing circuitry for adjustment of an initial setting when the hearing aid is turned on.

DETAILED DESCRIPTION OF THE PREFERRED EMBODIMENTS

Figure 1:
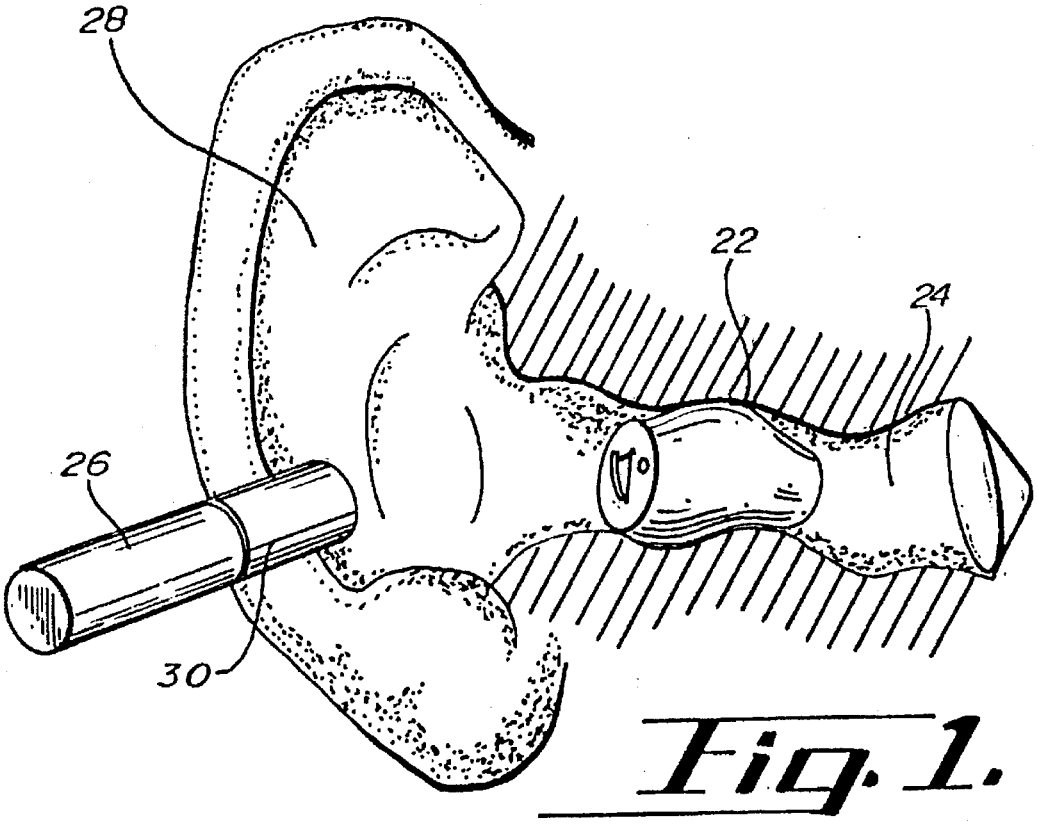
FIG. 1 is a partial sectional view showing a completely in the canal (CIC) hearing aid system in place which incorporates the invention.

Referring to FIG. 1, a preferred embodiment of the invention is depicted. The invention is a hearing aid system which principally comprises a hearing aid 22 which is shown in place in an ear canal 24 and a magnetic actuator 26 shown in an actuating position at the ear pinna 28. The hearing aid 22 has one or more adjustable operating parameters. The magnetic actuator 26 includes a magnet portion 30. The hearing aid as depicted is configured as a "completely in the canal" (CIC) type. The invention may also be embodied in the other conventional configurations of hearing aids such as "in the ear", "in the canal", "behind the ear", the eyeglass type, body worn aids, and surgically implanted hearing aids. Due to the extreme miniaturization of CIC hearing aids, the features of the invention are particularly advantageous in this type of aid.

Figure 2:
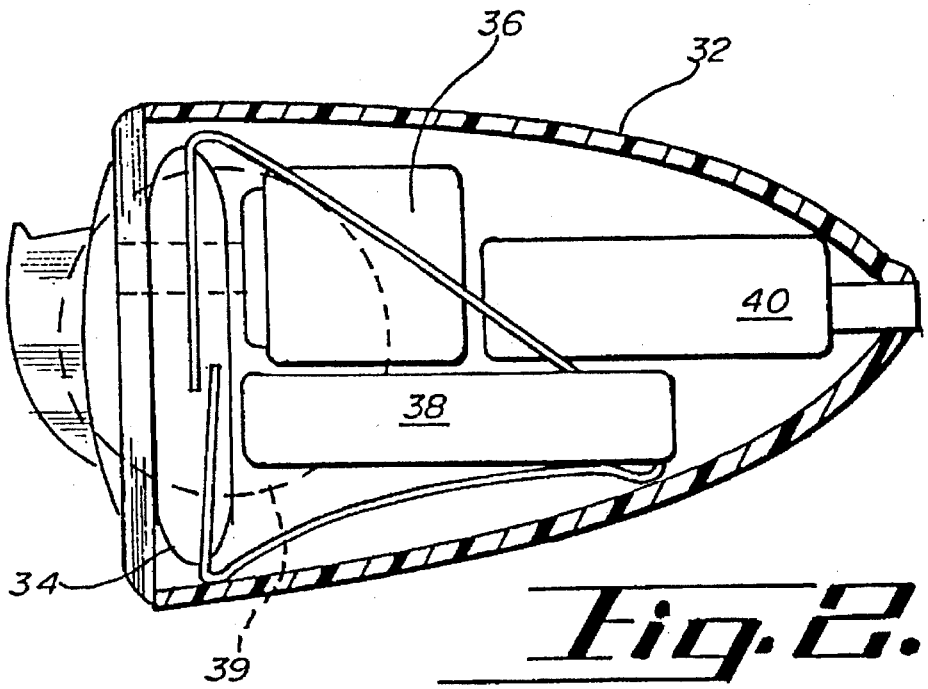
FIG. 2 is a partial sectional view showing one embodiment of a CIC hearing aid incorporating the invention.

FIG. 2 shows a cross sectional view of the CIC hearing aid 22. The hearing aid 22 includes a housing 32, a magnetic switch, shown as a reed switch 34, a microphone 36, hearing aid circuitry 38, a battery 39 and a receiver 40.

Figure 3:
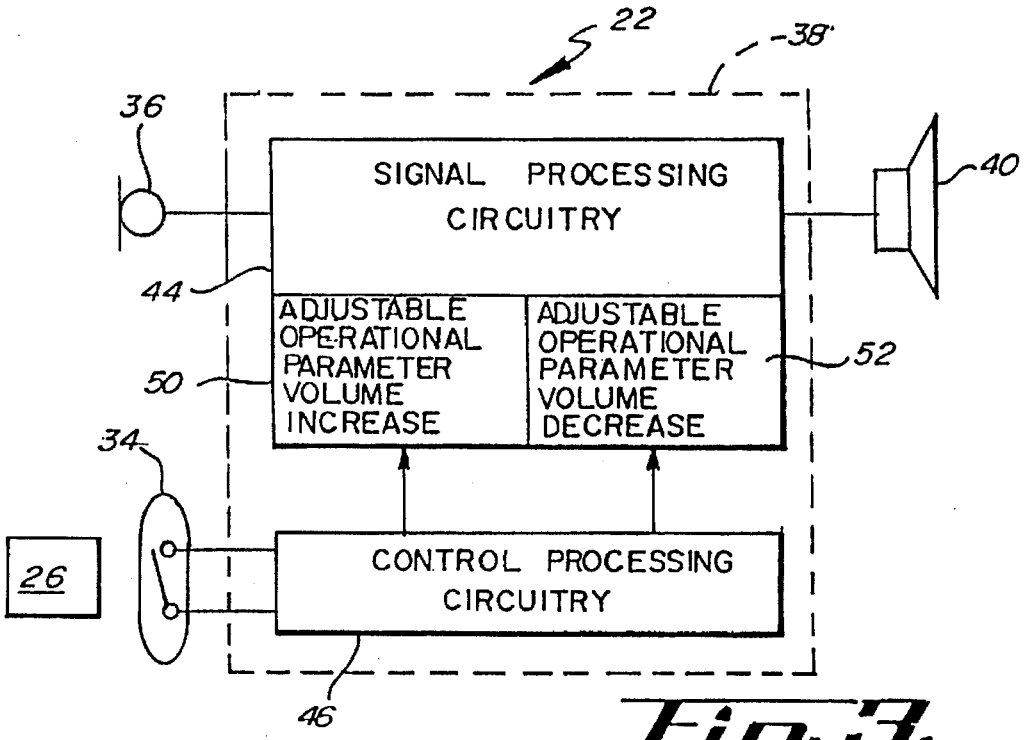
FIG. 3 shows a block diagram of one embodiment of the invention.

FIG. 3 shows a block diagram of one embodiment of the invention. In this embodiment the remote actuator controls volume increase and volume decrease. The hearing aid circuitry 38 comprises signal processing circuitry 44 and control processing circuitry 46. The signal processing circuitry 44 receives electrical signals generated by the microphone 36 and processes the signals as desired. Such processing would typically include amplification, filtering, and limiting. The processed signals are transmitted to the receiver 40. The signal processing includes a plurality of adjustable parameters 50, 52 identified in this embodiment as volume increase and volume decrease. The control processing circuitry 46 is connected to the magnetic switch 34 and translates actuations of the magnetic switch into control signals to adjust the adjustable operational parameters volume increase 50 and volume decrease 52. The control processing circuitry 46 is configured to switch between and adjust the operational parameters 50, 52 based upon the actuation of the magnetic switch and the maintenance of the actuation. This is accomplished by movement of the magnetic actuator into the proximity of the hearing aid and holding the actuator in said proximity. A suitable circuit corresponding to the block diagram of FIG. 3 is shown in FIG. 5 and discussed below.

The embodiment of FIG. 3 utilizes volume increase 50 and volume decrease 52 as the adjustable operational parameters. In other configurations, volume could be a single operational parameter, where used herein, volume and gain are synonymous. Numerous other adjustable operational parameters are available to control.

Figure 4:
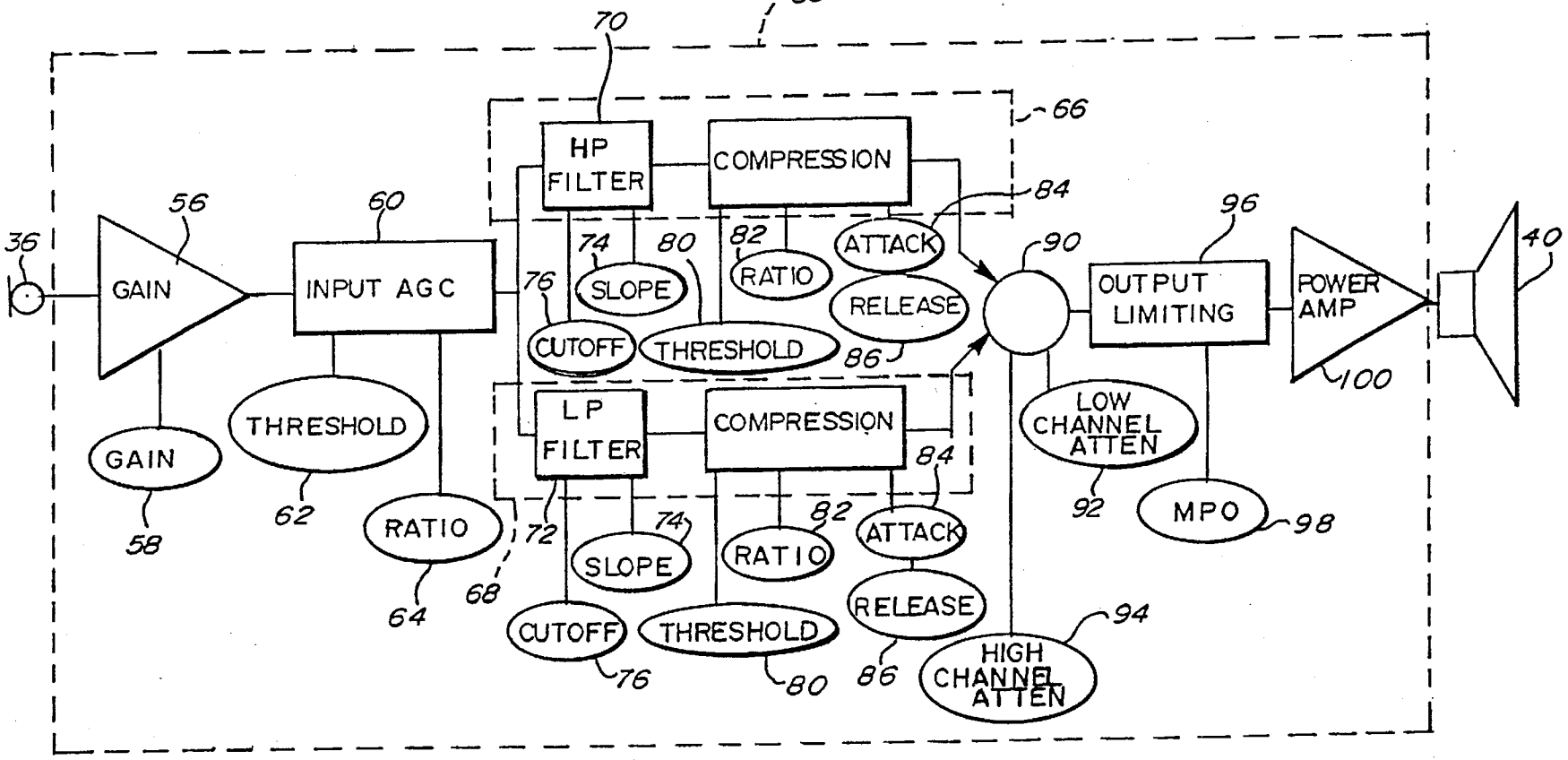
FIG. 4 shows a block diagram of a modern hearing aid with available adjustable operational parameters.

FIG. 4 exemplifies the adjustable operational parameters that are available in a modern hearing aid. FIG. 4 is a block diagram of the signal processing circuitry 44 which includes a number of circuit segments providing operational functions with associated adjustable operational parameters. It is not anticipated that all of the operational parameters shown in FIG. 4 would be adjustable in any particular hearing aid. Suitably, a select number of operational parameters would be selected for adjustment capabilities in a hearing aid. The signal from the microphone 36 goes to a preamp 56 in which the gain 58 is available as an adjustable parameter. The signal then goes to a input automatic gain control (AGC) 60 in which the threshold 62 and the AGC ratio 64 are available as adjustable parameters. The output from the AGC is split into two channels, a high channel 66 and a low channel 68. The high channel 66 has a high-pass filter 70 with available adjustable parameters of cutoff 74 and slope 76 and an AGC-compression circuit 78 with available adjustable parameters of threshold 80, ratio 82, attack time 84, and release time 86. The low channel 68 has analogous functions and available adjustable operational parameters. The high channel 66 signal and low channel 68 signal are combined in a summer 90 with available adjustable functions of low channel attenuation 92 and high channel attenuation 94. The signal then goes to the final power amplifier 100 having maximum power output 98 available as an adjustable parameter. Volume or gain control 102 is available on the line 104 to the power amplifier 100. The final power amplifier 100 amplifies the signal for the output transducer 40.

Figure 5:
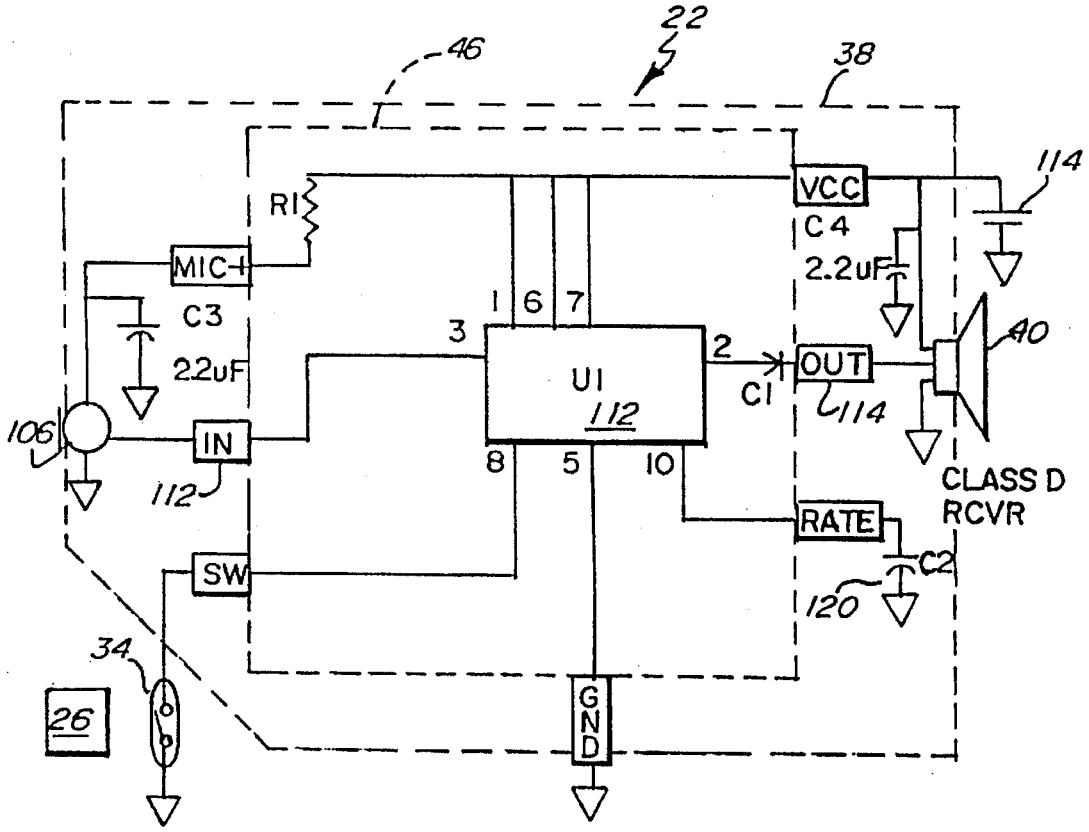
FIG. 5 is a schematic diagram of the embodiment of the invention shown in FIG. 3.

FIG. 5 shows a schematic diagram of the embodiment of the hearing aid 22 of FIG. 3. The hearing aid 22 utilizes a conventional hearing aid microphone 106 which includes a preamp mounted within the microphone enclosure and a Class D receiver 108 which comprises a Class D amplifier included with an earphone. Therefore, the hearing aid circuitry 38, identified by the dashed lines, is shown extending through the microphone 106 and the receiver 108. Such microphones and receivers are available from Knowles Electronics, Itasca, Ill. The control processing circuitry is comprised of an integrated circuit chip 112 which controls the volume increase and the volume decrease. A battery 114 provides power to the microphone 106, the Class D receiver 108, and the IC chip 112.

The volume is increased and decreased by varying the impedance of the IC through the IC input 116 at (pin 3) and the IC output 118 (pin 2). The IC 112 is suitably a GT560 transconductance block manufactured by the Gennum Corporation. Details regarding the design and operating specifications are available in the GT560 Data sheet available from Gennum Corporation, P.O. Box 489, Station A, Burlington, Ontario, Canada L7R 3Y3 which is incorporated herein by reference.

The IC chip 112 is configured whereby the impedance is increased or decreased dependent upon the sequencing and duration of the shorting of the pin 8 to power source Vcc. which is accomplished through the actuation of the magnetic switch 34. Upon shorting of the pin 8, the volume decrease (or increase) does not commence for a predefined period of time determined by the value of the capacitor 120. An appropriate period of time would be one to two seconds. The embodiment of FIG. 5 operates as follows:

The magnetic actuator 26 is moved into proximity of the hearing aid 22 and thus the magnetic switch 34, actuating the switch 34. When used herein "into proximity" refers to the range from the hearing aid in which the magnetic actuator will actuate the magnetic switch. The magnetic actuator 26 is maintained in proximity to said switch for a period of time after which the impedance is ramped upwardly at a predetermined rate resulting in a volume decrease. The increase in impedance (and decrease in volume) continues as long as the magnetic actuator 26 is maintained in proximity to the magnetic switch 34 until the maximum impedance of the IC chip 112 is reached. If the magnetic actuator 26 is moved out of proximity with the magnetic switch 34, the increase in impedance freezes at whatever point it is currently at. When the magnetic actuator 26 is returned to proximity with the magnetic switch 34 the impedance commences ramping downwardly, increasing the volume until the magnetic actuator 26 is moved out of proximity or until the minimum impedance is reached. Thus, the sequential movement of the magnetic actuator 26 into and out of proximity with the hearing aid 22 alternates the control processing circuitry 46 between the two adjustable operational parameters of volume decrease and volume increase. Holding the magnetic actuator 26 within the proximity of the hearing aid increases or decreases the volume dependent upon which operational parameter is selected.

Figure 6:
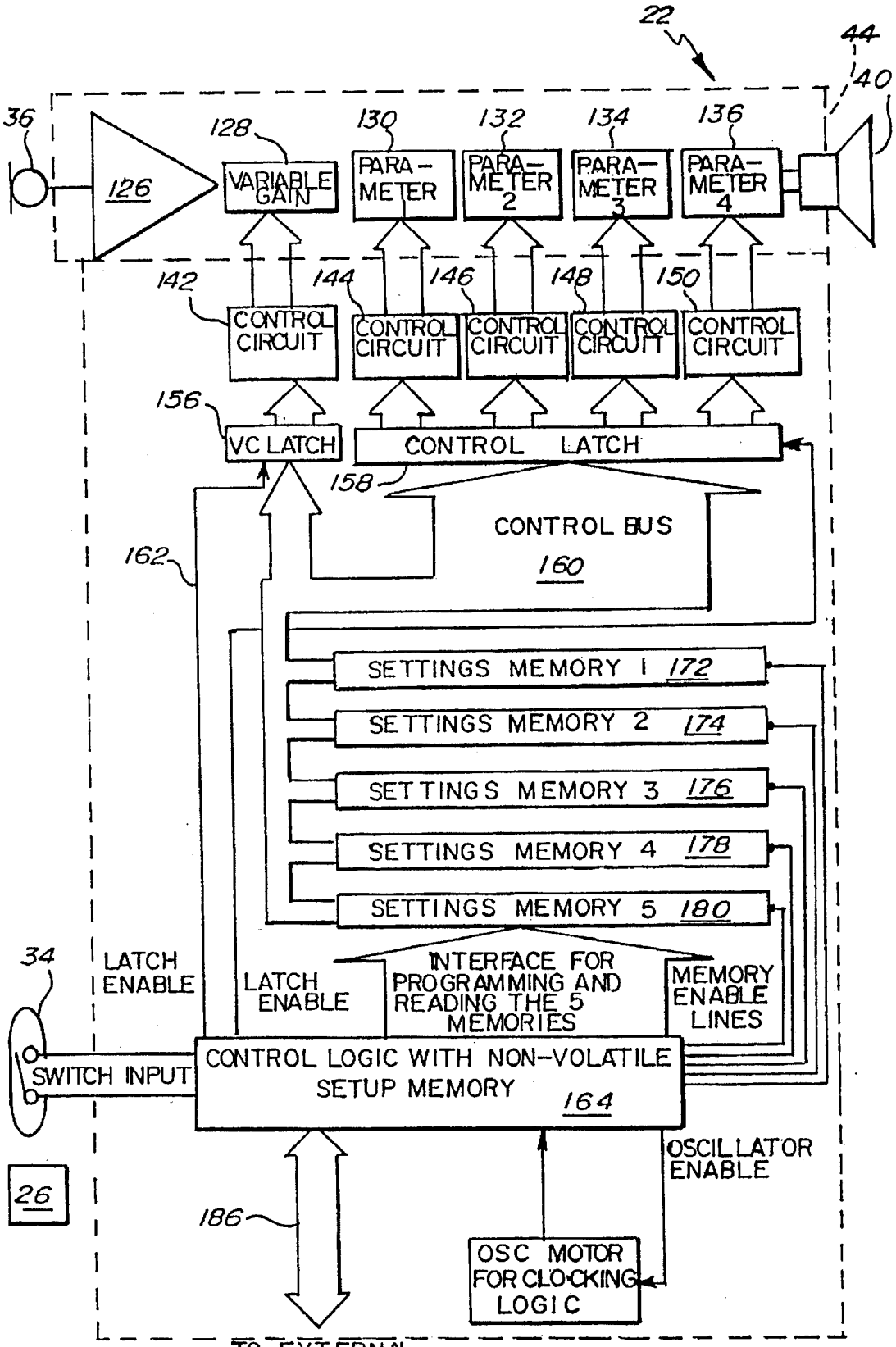
FIG. 6 shows a block diagram of an additional embodiment of the invention.

An additional embodiment is shown by way of a block diagram in FIG. 6. In this embodiment the user may, through use of the magnetic actuator, adjust the volume of the aid and select any of five different programs for different listening environments. Each of the five programs provide for separate settings for five adjustable parameters including volume control. The programs are groups of settings of the adjustable operational parameters that would typically be preprogrammed into the hearing aid 22 by the acoustician through an appropriate interface. The adjustable parameters could be any of the parameters shown in FIG. 4.

Continuing to refer to FIG. 6, this embodiment has a microphone 36, a receiver 40, a magnetic switch 34, and hearing aid circuitry 38. The hearing aid circuitry 38 includes signal processing circuitry 44, and control processing circuitry 46. The signal processing circuitry 44 has an amplifier 126 and volume control or variable gain 128 as an adjustable operational parameter along with four other adjustable operational parameters 130, 132, 134, 136 which may be such as those discussed with reference to FIG. 4 above. The control processing circuitry 46 includes five control circuitry blocks 142, 144, 146, 148, 150 which translate a digital control word from the volume control (VC) latch 156 or control latch 158 to switch closures or to adjust a discrete electrical analog quantity required to change the signal processing action of the respective adjustable operational parameters 128, 130, 132, 134, 136. The control circuitry blocks 142, 144, 146, 148, 150 are of conventional design utilizing digital control logic to provide the specific control settings for each adjustable parameter. Such control logic is familiar to those skilled in the art and is described with reference to FIG. 7 below.

In the embodiment of FIG. 6, the volume control is the only operational parameter that the user can independently adjust. Initial volume settings are programmed into each setting memory by the acoustician. Thereafter, toggling the latch enable 162 through the control logic controls the volume gain 128.

Each settings memory 172, 174, 176, 178, 180 contains a digital word that translates into a group of settings of the adjustable operational parameters 128, 130, 132, 134, 136. These memories are suitably read and loaded by an external programmer, not shown, which interfaces with the control logic 164 by way of a programming interface 186. The programming interface 186 may be through various known means such as hard wire, RF or infrared radiation, acoustic or ultrasonic signals. Ideally the settings memories 172, 174, 176, 178, 180 should be nonvolatile, to maintain their contents in the absence of battery power.

The control logic coordinates the system function by interfacing the external programmer to settings memories; sequencing, selecting and transferring a settings memory to the control latch 158; sequencing and transferring control words to the VC latch 156; reading the switch input 188 from the magnetic switch 34; timing human and programmer interface operation; and preserving the volume control setting and settings memory address in use at power down and transferring these control words to the appropriate latches at power-on.

The control bus 160 carries the digital word from the selected settings memory to the VC latch 156 and control latch 158.

The details of the hearing aid circuitry and the programming of the control logic would be apparent to those skilled in the art and need not be disclosed in detail.

Figure 7:
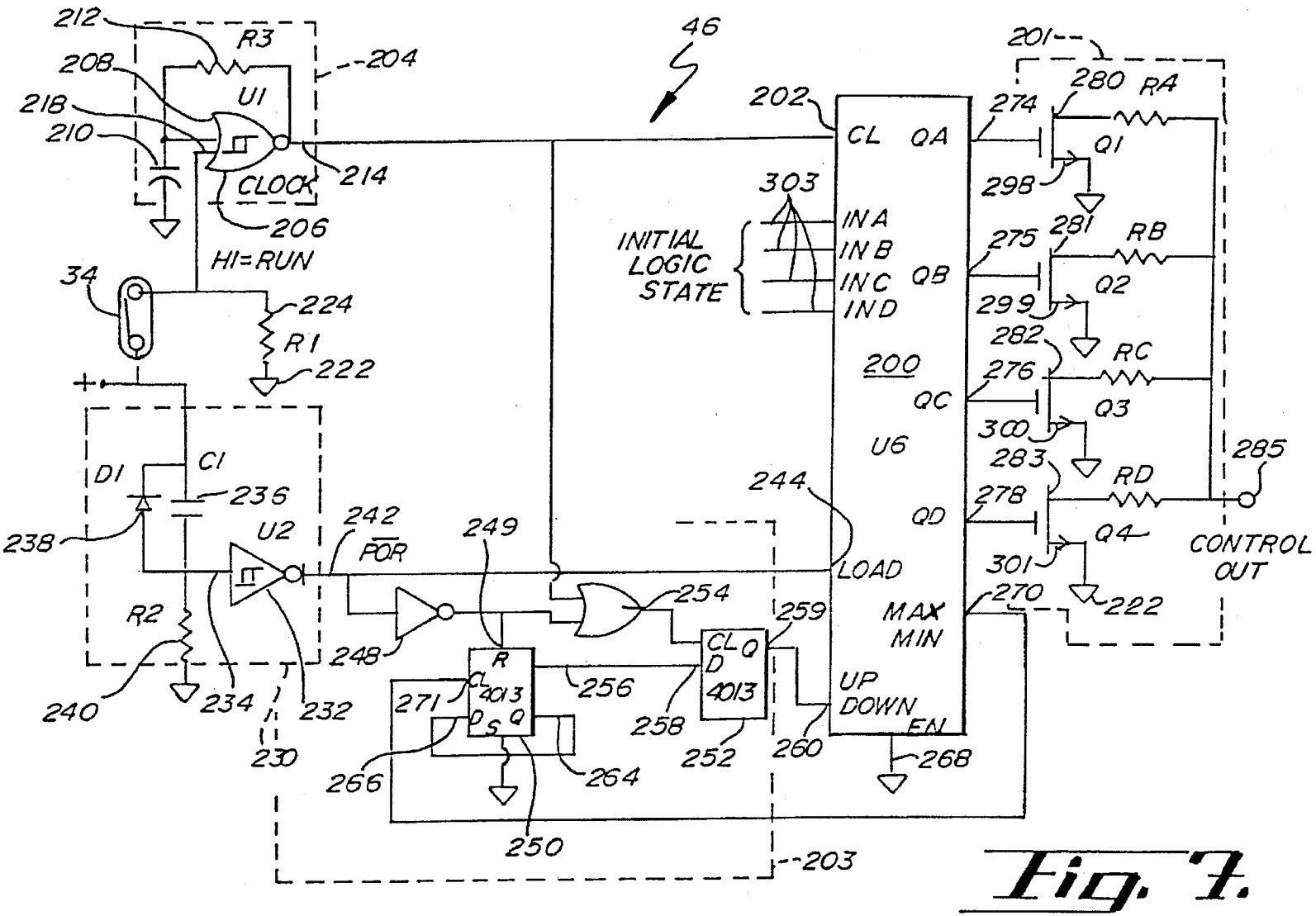
FIG. 7 is a schematic of an example of control processing circuitry that provides for continued cycling between maximum and minimum settings of an adjustable operational parameter.
Figure 8:
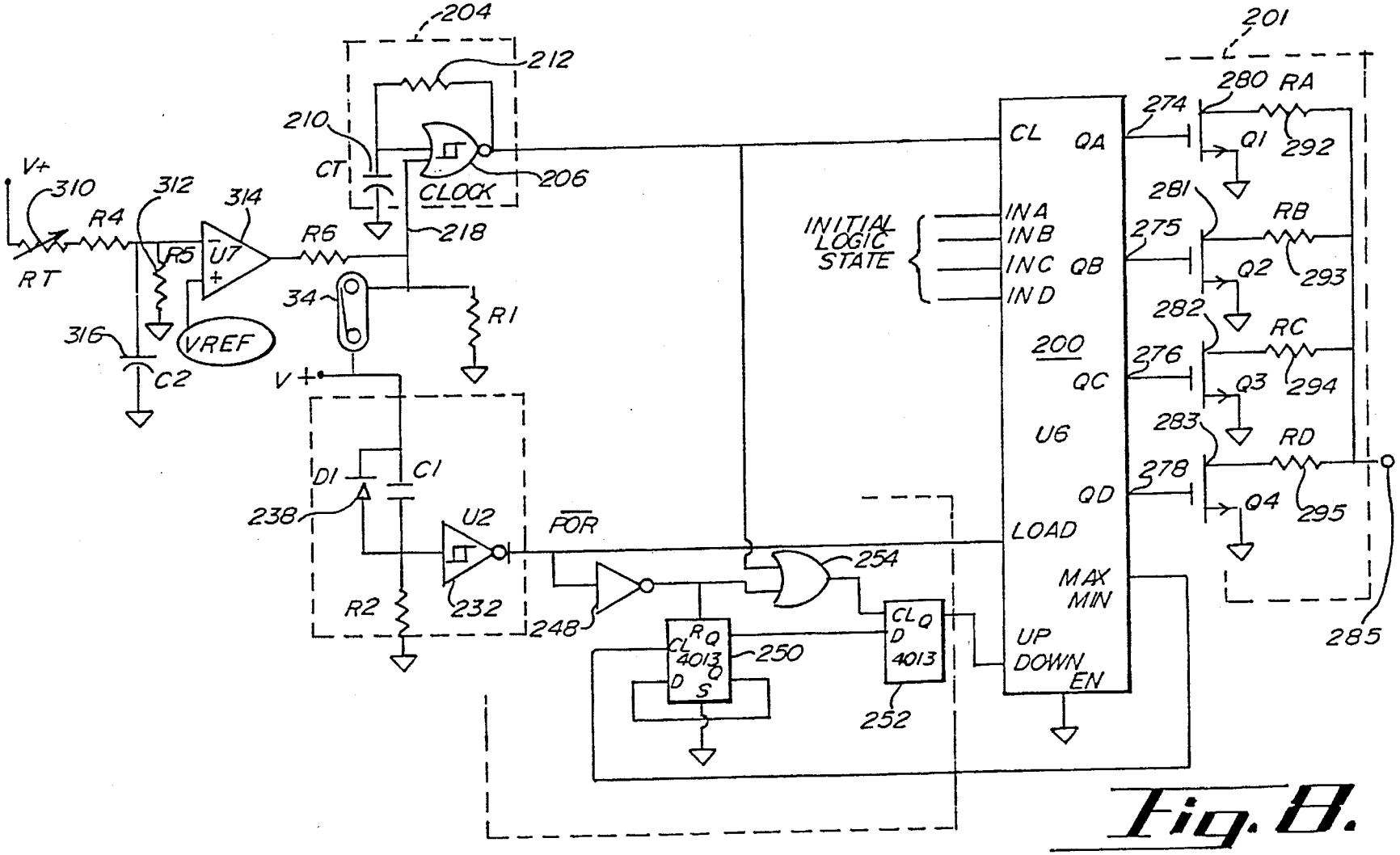
Figure 9:
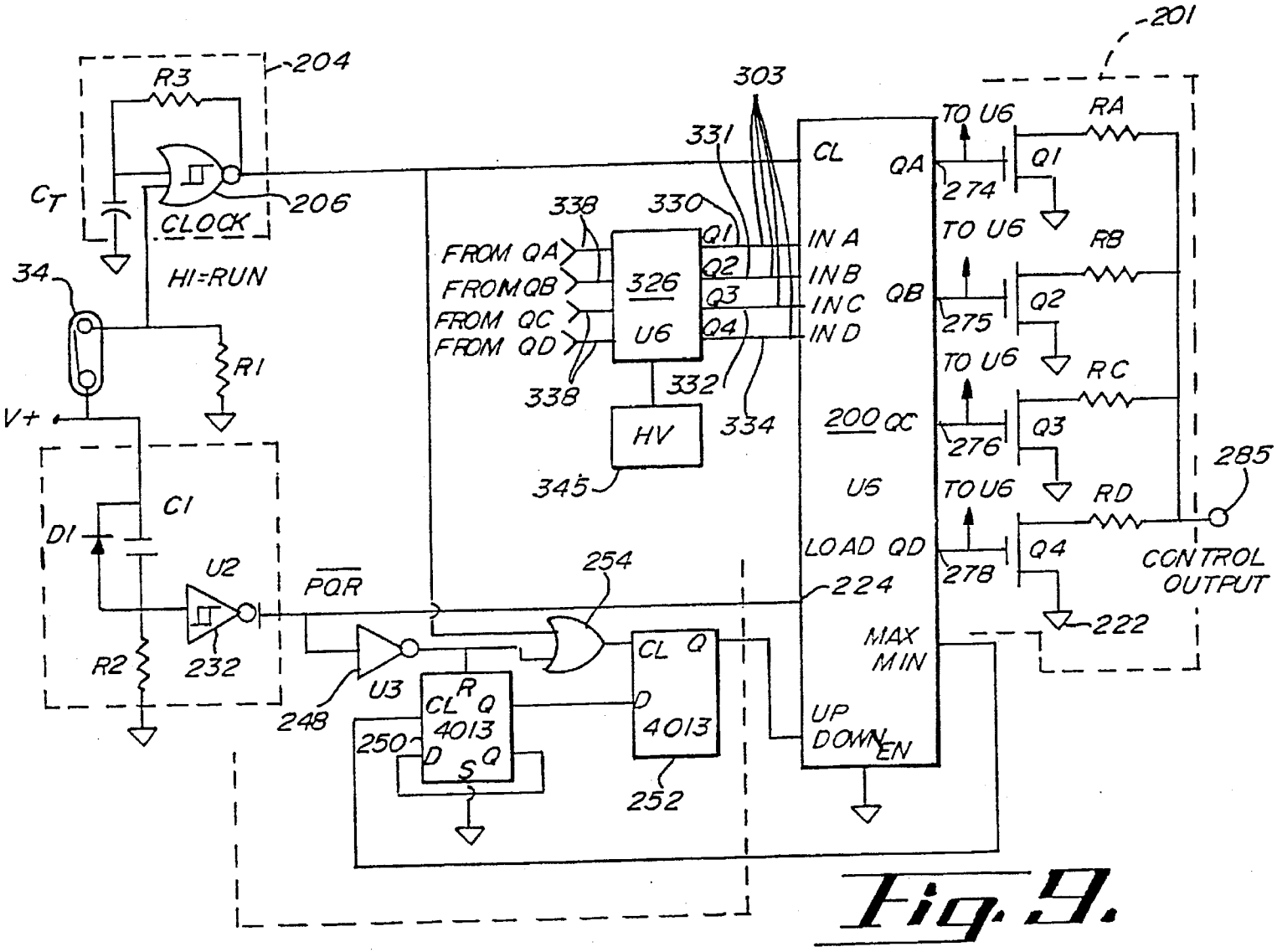
FIG. 9 is a schematic of an example of control processing circuitry in which the last setting of the adjustable parameter is saved when the hearing aid is turned off.

FIGS. 7, 8 and 9 depict examples of control processing circuitry to provide alternate control characteristics of an adjustable parameter such as volume. These examples show discrete components which are not generally suitable for in-the-ear hearing aids. Similar analogous circuitry may be utilized in a hybrid IC for miniaturization and placement in the ear.

FIG. 7 discloses an example of control processing circuitry 46 that provides for ramping up and down by steps and continuous cycling between minimum and maximum settings. This control circuitry is suitable for adjusting hearing aid volume. The principle components are a counter designated with the element number 200, a conversion ladder 201, additional logic circuitry 203 to control the counter direction, and a clock oscillator 204. A conventional LS191 counter provides an example of a suitable counter design. The clock input 202 of the counter 200 is connected to a Schmitt AND gate clock oscillator 204 comprised of a dual input NAND device 206, with one input 208 grounded through a capacitor ($C_T$) 210 and a resistor R3 212 bridging the first input 208 and the output 214 of the NAND device 206. The second input 218 to NAND device 206 is switched to the supply voltage V+ through the magnetic switch 34 and is connected to ground 222 through resistor R1 224.

A Power On Reset (POR) circuit 230 comprised of a Schmitt inverter 232 with the input 234 connected to supply voltage through a capacitor C1 236 and diode D1 238, and to ground through resistor R2 240. The Schmitt inverter 232 outputs to a POR line 242 connected to the LOAD node 244 of the LS191 counter 200 and to an inverter device 248. The inverter device 248 outputs to a reset input 249 of a first flip flop 250 and inputs to the clock input 251 of a second flip flop 252 through a dual input OR gate U5 254. The flip flops 250, 252 are conventional type 4013 flip flops. The other input of the OR gate 254 is connected to the output 214 of the NAND device 206. The output 256 of flip flop 250 is connected to the D input 258 of the flip flop 252. The Q output 259 of flip flop 252 is connected to the UP/DOWN input 260 of the counter 200. The Q output 264 of flip flop 250 is connected to its D input 266.

The enable input node 268 of the counter 200 is grounded. The MAX/MIN output node 270 connects to the clock C1 input 271 of the flip flop 250. The outputs $Q_A$, $Q_B$, $Q_C$, $Q_D$, designated by the numerals 274, 275, 276, 278 respectively, are connected to the bases of four NMOS transistors Q1, Q2, Q3, Q4, also designated by the numerals 280, 281, 282, 283. The collectors 286, 287, 288, 289 are connected to appropriately weighted resistors $R_A$, $R_B$, $R_C$, $R_D$, also designated by the numerals 292, 293, 294, 295, and the emitters 298, 299, 300, 301 are all grounded. The initial logic state inputs 303 to the counter 200.

The control processing circuitry 46 operates as follows: When power is switched on, the clock 205 is disabled by the low on the 218 input caused by the R1 224 to ground and the open magnetic switch 34. When power is initially applied to the Power On Reset (POR) circuit 230, a logic low POR pulse is momentarily applied to the POR line 242. The POR pulse is directly applied to the LOAD node 244 of the counter 200, which causes an arbitrary initial logic state present at inputs INA, INB, INC, and IND to be loaded into the counter as a starting value. The POR pulse is inverted by inverter 248, applying a momentary pulse to the reset input 249 of the first flip flop 250. This causes a logic low to appear at the Q output of the first flip flop 250 and consequently, at the D input 258 of the second flip flop 252. This logic low is transferred to the second flip flop 252 Q output 259 by a clocking of its clock (CL) input 255 by the inverted POR pulse via the OR gate 254. The end result is an initial low level on the -UP/DOWN input 260 of the counter 200, configuring the counter 200 as a binary up-counter.

The initial POR state is maintained until clocking commences by actuation of the magnetic switch 34. When the switch 34 is closed the clock oscillator 204 starts and runs continuously as long as the magnetic switch remains closed. The counter 200 is incremented by one upon each low to high transition of the clock oscillator 204 until the count reaches 15, or binary "1111" on the counter outputs 274, 275, 276, 278. At this point the MIN/MAX output 270 of the counter 200 goes high for one clock cycle. This toggles the first flip flop 250 to its alternate state. Initially the Q output 256 changes from low to high, The next clock transition changes this logic high to the -UP/DOWN input 260 of the counter 200 by way of the second flip-flop 252. The counter 200 now becomes a down counter and proceeds to count from decimal 15 to 0 on each subsequent clock pulse. When the counter 200 reaches 0, the MIN/MAX output 270 generates another pulse which toggles itself back up to the "UP" counting mode. The 4 bit binary appearing on the output of the counter 200 is translated to an analog level by way of the selective activation of the NMOS transistors 280, 281, 282, 283 resulting in a resistance between the control output 285 and ground that cycles in steps between substantially 0 ohms and the total value of the four sequentially weighted resistors, 292, 293, 294, 295. With reference to FIG. 4, such a circuitry can be used to control the volume or gain of a hearing aid by way of connection to the preamp 56, the power amp 100 or the line 104 to the power amp.

An embodiment of the invention utilizing the control circuitry of FIG. 7 would operate as follows: The user turns on the aid 22. To adjust the volume, the user brings the magnetic actuator 26 into proximity with the magnetic switch 34. Continuing to hold the magnetic actuator 26 in said proximity (holding the switch 34 closed) will start to ramp the volume up to maximum volume and then to ramp the volume down to minimum volume and so on in a continuing cycle until the user moves the magnetic actuator 26 out of proximity. If the magnetic actuator 26 is again moved into proximity the hearing aid 22 volume or gain will again commence cycling until the actuator 26 is moved out of proximity. In this embodiment the volume increase and volume decrease is considered a single adjustable operation parameter. The circuitry of FIG. 7 may be suitably adapted for controlling any of the adjustable operational parameters of FIG. 4.

Referring to FIG. 8, the control circuitry of FIG. 7 has been modified to provide an initial adjustable POR condition. The initial setting is adjusted by an external trimmer (RT) 310. At power-on, resistor (R5) 312 holds the inverting input of a comparator (U7) 317 near ground potential, a point lower than its noninverting input. This causes the output of the comparator 314 to approach the supply voltage V+. This signal constitutes a high logic level and is connected to the second input 218 of the NAND gate 206. The high logic level causes the clock oscillator 204 to run, advancing the counter 200. The counter will count upward in increments of one binary digit for each clock pulse until the clock oscillator 204 is halted by a logic low which will occur when the capacitor (C2) 316 reaches a particular charge. The time the clock oscillator 204 continues to count after power-up thus determines the count of the counter 200 and thus the initial resistance at the control output. As described previously, the variable resistance of the control output 285 is suitably inserted in the hearing aid signal processing circuitry for control of the desired adjustable parameter, for example, volume. Thus, the initial volume level setting whenever the apparatus is turned on may be adjusted.

Referring to FIG. 9, an additional modification of the control circuitry of FIG. 7 which allows storage of the last user's volume (or other adjustable parameter) setting. This circuit has a memory 326 in the form of a conventional EEPROM device. The memory 326 is nonvolatile with the outputs 330, 331, 332, 333 of the memory 326 connected to the initial logic state inputs 303 of the counter 200 and with the inputs 338 connected to the outputs 274, 275, 276, 278 of the counter 200. The memory is provided with a high voltage supply 345, consisting of conventional circuits, well known in the art. The state of the counter 200, which directly controls the operation of the signal processing circuitry, is always mirrored in the state of the EEPROM memory 326. When power is removed from the circuit, that is the hearing aid is turned off, the memory 326 retains the last setting. When the hearing aid is turned back on the POR signal at the LOAD input 244 of the counter 200 initiates loading of the contents of the EEPROM memory 326 into the inputs 303 of the counter 200 returning the resistance between the control output 285 and ground to the state it was in prior to the hearing aid being turned off and thus returning the signal processing circuitry to its state before it was turned off. Where, for example, volume is the adjustable operational parameter controlled by the resistance between the control output 285 and ground 222, then the volume is returned to its state before the hearing aid was turned off.

Although the magnetic switch 34 has been depicted as a reed switch, other types of magnetic sensors are anticipated and would be suitable for this invention. Such sensors would include hall effect semiconductors, magneto-resistive sensors, and saturable core devices. Where used herein, magnetic switch is defined to include such sensors. Similarly, the magnetic actuator maybe any magnetic source such as a permanent magnet or an electromagnet.

Although the control processing circuitry as shown, particularly in FIGS. 7, 8, and 9 is digital, it is apparent that analog circuitry would also be suitable.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A magnetically controlled hearing aid comprising:

a) a microphone for generating electrical signals from acoustical input;

b) a single magnetic switch actuatable by the presence of a magnetic field and deactuatable by the removal of the magnetic field;

c) an output transducer earphone for transforming processed electrical signals into a user compatible form; and d) hearing aid circuitry connected to the microphone, the output transducer, and the magnetic switch, the hearing aid circuitry comprising signal processing circuitry and control processing circuitry for controlling the signal processing circuitry, the signal processing circuitry configured for processing said electrical signals generated by the microphone, the signal processing circuitry including an adjustable operational parameter, said adjustable operational parameter having a minimum setting, a plurality of mid-range settings and a maximum setting and wherein the control processing circuitry is configured to repeatedly cycle through said minimum setting, said plurality of mid-range settings and said maximum settings exclusively by actuation of said single magnetic switch whereby a desired setting may be selected, changed, and reselected solely by operation of said single magnetic switch.

2. The hearing aid of claim 1, wherein the control processing circuitry is configured to continue to adjust the adjustable operational parameter while the actuation of the magnetic switch is sustained and to cease adjusting said operational parameter when the magnetic switch is deactuated.

3. The hearing aid of claim 1, wherein the adjustable operational parameter is volume.

4. The hearing aid of claim 1, wherein the adjustable operational parameter is volume and wherein the control processing circuitry is configured such that when actuation of the magnetic switch is sustained the volume is incrementally adjusted.

5. The hearing aid of claim 1, wherein the adjustable operational parameter is volume, wherein the hearing aid further comprises a power switch for switching the hearing aid on and off, and wherein the control processing circuitry is configured to adjust the volume to the minimum setting when the hearing aid is switched on.

6. The system of claim 1 wherein the output transducer, the microphone, the magnetic switch, and the hearing aid circuitry are contained within a housing, and wherein the housing is configured to be inserted into the ear canal.

7. The hearing aid of claim 1, wherein the adjustable parameter has a minimum setting and a maximum setting and wherein the control processing circuitry is further configured such that when the magnetic switch actuation is sustained the setting of the adjustable operational parameter has a cycle in which said setting is initially ramped upwardly to the maximum setting and then the setting is ramped downwardly to the minimum setting.

8. The hearing aid of claim 1, wherein the hearing aid has a power switch for switching the hearing aid on and off and the hearing aid circuitry is further comprised of a memory connected to the control processing circuitry, the control processing circuitry configured for storing in said memory the setting of the adjustable parameter when said hearing aid is switched off and further configured to adjust the operational parameter to the setting stored in said memory when the hearing aid is subsequently switched on.

9. The hearing aid of claim 1, wherein the control processing circuitry is further configured for switching the hearing aid on and off and wherein the plurality of settings has an initial setting, the adjustable setting adjusts to the initial setting when the hearing aid is switched on, the control processing circuitry further comprising an adjustable trimmer control whereby said initial setting may be adjusted.

10. The hearing aid of claim 1, wherein the control processing circuitry is further configured such that the adjustable setting is first moved towards the maximum setting upon actuation of the single magnetic switch and is then moved toward the minimum setting upon a subsequent actuation of the single magnetic switch.

11. The hearing aid of claim 1, wherein the adjustable operational parameter is volume and wherein the control processing circuitry is further configured such that the volume is first adjusted downwardly upon actuation and the sustaining of the actuation of the magnetic switch and is then adjusted upwardly upon a subsequent actuation and the sustaining of the actuation of the magnetic switch.

12. The hearing aid of claim 1, wherein the adjustable operational parameter is volume and wherein the control processing circuitry is further configured such that the volume is first adjusted upwardly upon actuation and the sustaining of the actuation of the magnetic switch and is then adjusted downwardly upon a subsequent actuation and the sustaining of the actuation of the magnetic switch.

13. The hearing aid system of claim 12, wherein the hearing aid is a completely in the canal type of hearing aid.

14. A magnetically controlled hearing aid comprising:

a) a microphone for generating electrical signals from acoustical input;

b) a single magnetic switch actuatable by the presence of a magnetic field and deactuatable by the removal of the magnetic field;

c) an output transducer earphone for transforming processed electrical signals into a user compatible form; and d) hearing aid circuitry connected to the microphone, the output transducer, and the magnetic switch, the hearing aid circuitry comprising signal processing circuitry and control processing circuitry for controlling the signal processing circuitry, the signal processing circuitry configured for processing said electrical signals generated by the microphone, the signal processing circuitry including adjustable gain setting, said adjustable gain setting adjustable through a plurality of settings having a minimum setting and a maximum setting, the control processing circuitry configured to repeatedly cycle the gain setting through the plurality of settings exclusively by way of actuation of the single magnetic switch.

* * * * *